US006804172B2

(12) United States Patent
Matoge et al.

(10) Patent No.: US 6,804,172 B2
(45) Date of Patent: Oct. 12, 2004

(54) ANALOG ELECTRONIC TIMEPIECE INCLUDING PLURAL INDICATOR WHEELS

(75) Inventors: Akihiro Matoge, Chiba (JP); Koichiro Jujo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 349 days.

(21) Appl. No.: 10/093,793

(22) Filed: Mar. 7, 2002

(65) Prior Publication Data

US 2003/0169643 A1 Sep. 11, 2003

(51) Int. Cl.[7] ..... G04B 19/02; G04B 31/00
(52) U.S. Cl. ..... 368/220; 368/322
(58) Field of Search ..... 368/76, 80, 220, 368/223, 322–324

(56) References Cited

U.S. PATENT DOCUMENTS 2,872,775 A * 2/1959 Maire ..... 368/220
3,290,875 A * 12/1966 Egger et al. ..... 368/220
4,274,153 A * 6/1981 Kume et al. ..... 368/80
4,684,263 A * 8/1987 Etienne ..... 368/220
4,907,210 A * 3/1990 Sato et al. ..... 368/80
5,617,376 A * 4/1997 Honzawa et al. ..... 368/80

* cited by examiner

*Primary Examiner*—Vit W. Miska
(74) *Attorney, Agent, or Firm*—Adams & Wilks

(57) ABSTRACT

An analog electronic timepiece has a rotor mounted to undergo rotation. A first indicator wheel has a first cylindrical portion and undergoes rotation in accordance with rotation of the rotor. A second indicator wheel is coaxial with the first indicator wheel and undergoes rotation in accordance with rotation of the first indicator wheel. The second indicator wheel has a second cylindrical portion extending through the first cylindrical portion of the first indicator wheel. A third indicator wheel is coaxial with the first and second indicator wheels and undergoes rotation in accordance with rotation of the second indicator wheel. The third indicator wheel having a shaft portion extending through the second cylindrical portion the second indicator wheel.

11 Claims, 14 Drawing Sheets

ANALOG ELECTRONIC TIMEPIECE INCLUDING PLURAL INDICATOR WHEELS

BACKGROUND OF THE INVENTION

1. Field of the Invention

The present invention relates to an analog electronic timepiece including plural indicator wheels. The present invention particularly relates to an analog electronic timepiece including a plurality of indicator wheels coaxially rotated and attaching indicating members such as indicators to the respective indicator wheels.

The invention can realize an analog electronic timepiece having a high degree of freedom in designing an indicator and having a novel and easy-to-see indicating portion.

2. Background Information

Generally, a "movement (machine body)" of an analog electronic timepiece is provided with a main plate constituting a board of the movement. Further, a movement (machine body) contained in a wrist watch case is referred to as "complete". A wrist watch case includes a case body, a "case back" and "glass".

Further, in both sides of a main plate, a side having a dial is referred to as "back sides" of an analog electronic timepiece and in the both sides of the main plate, a side opposed to the dial is referred to as "top side" of an analog electronic timepiece. Further, a train wheel integrated to the top side of an analog electronic timepiece is referred to as "top train wheel" and a train wheel integrated to the back side of an analog electronic time piece is referred to as "back train wheel".

Therefore, a "case back" of a wrist watch case is arranged to face the "top side" of an analog electronic timepiece and "glass" of a wrist watch case is arranged to face the "back side" of the analog electronic timepiece and is arranged to face a dial.

Further, numerals from "1" to "12" or the like are frequently described on a dial or an outer peripheral portion of a case (case body, bezel or the like) of an analog electronic timepiece. Therefore, respective directions along the outer peripheral portion of the analog electronic timepiece are expressed by using the numerals. For example, in the case of a wrist watch, an upper direction and an upper side of the wrist watch are respectively referred to as "12 o'clock direction" and "12 o'clock side", a right direction and a right side of the wrist watch are respectively referred to as "3 o'clock direction" and "3 o'clock side", a lower direction and a lower side of the wrist watch are respectively referred to as "6 o'clock direction" and "6 o'clock side" and a left direction and a left side of the wrist watch are respectively referred to as "9 o'clock direction" and "9 o'clock side".

Generally, according to an analog electronic timepiece, a drive portion, a control portion and a top train wheel are integrated to a top side of the timepiece. Further, in the wrist watch, a switch portion may be integrated to the top side of the timepiece, may be integrated to the back side of the timepiece, or may be integrated to both of the top side and the back side of the timepiece.

A conventional three hands analog electronic timepiece is constituted such that by rotation of a rotor constituting a step motor, a second wheel & pinion (corresponding to a wheel for indicating second) is decelerated to rotate via rotation of a fifth wheel & train, by rotation of the second wheel & pinion, a center wheel & pinion (corresponding to a wheel for indicating minute) is decelerated to rotate via rotation of a third wheel & pinion and by rotation of the center wheel & pinion, an hour wheel (corresponding to a wheel for indicating hour) is decelerated to rotate via rotation of a minute wheel.

A rotational center of the second wheel & pinion, a rotational center of the center wheel & pinion and a rotational center of the hour wheel are arranged at the same position. That is, the second wheel & pinion, the center wheel & pinion and the hour wheel are constituted to rotate coaxially.

A cylindrical portion of the center wheel & pinion is arranged to penetrate a cylindrical portion of the hour wheel and a shaft portion of the second wheel & pinion is arranged to penetrate the cylindrical portion of the center wheel & pinion. A second hand is attached to the second wheel & pinion, a minute hand is attached to the center wheel & pinion and an hour hand is attached to the hour wheel. Further, in the case of a two hands analog electronic timepiece, a secondhand is not provided.

A structure of such a conventional analog electronic timepiece is disclosed in, for example, Japanese Patent Laid-Open No. 86283/1978, Japanese Patent Laid-Open NO. 67678/1980, Japanese Patent Laid-Open No. 189577/1983 or the like.

Further, in Japanese Utility Model. Laid-Open No. 96489/1988, there is disclosed a structure of a timepiece having a cover member in a projected shape and arranged with an hour hand, a minute hand and a second hand bent to follow a shape of an inner side of the cover member in an order of proximity to a movement.

However, according to the conventional analog electronic timepiece, the cylindrical portion of the center wheel & pinion is arranged to penetrate the cylindrical portion of the hour wheel, the shaft portion of the second wheel & pinion is arranged to penetrate the cylindrical portion of the center wheel & pinion and therefore, a degree of freedom of designing a second hand, a minute hand and an hour hand is considerably restricted.

In other words, according to the conventional analog electronic timepiece, when the second wheel & pinion is attached with an indicator having large moment of inertia such as a thick indicator, a long indicator, or an indicator having a special shape, a value of the moment of inertia of the indicator is restricted and there poses a problem that an indicator having large moment of inertia cannot be attached to the second wheel & pinion.

Further, according to the conventional analog electronic timepiece, when an hour hand having a large moment of inertia (that is, having a large weight, three-dimensional shape or the like) is attached to a cylindrical portion of an hour wheel having a large rotation drive torque, an hour hand base seat constituting a base of the hour hand is attached to a cylindrical portion of the hour wheel and the hour hand having a large moment of inertia is attached to the hour hand base seat. By this construction, the operability for attaching and detaching the hour hand is difficult to accomplish.

SUMMARY OF THE INVENTION

It is an object of the invention to provide an analog electronic timepiece capable of attaching an hour hand not to a cylindrical portion but to a shaft portion.

It is another object of the invention to enhance a degree of freedom of designing a second hand, a minute hand and an hour hand in an analog electronic timepiece.

In order to resolve the above-described problem in the conventional art, according to an aspect of the invention, there is provided an analog electronic timepiece comprising a rotor constituting a motor, a first indicator wheel decelerated to rotate based on rotation of the rotor, a second indicator wheel decelerated to rotate based on rotation of the first indicator wheel, and a third indicator wheel decelerated to rotate based on rotation of the second indicator wheel.

According to the aspect of the electronic timepiece of the invention, the first indicator wheel includes a cylindrical portion, the second indicator wheel includes a cylindrical portion and the third indicator wheel includes a shaft portion, the first indicator wheel, the second indicator wheel and the third indicator wheel being constituted to coaxially rotate by making respective rotational centers thereof the same as each other.

Further, according to the aspect of the electronic timepiece of the invention, the cylindrical portion of the second indicator wheel is constituted to penetrate the cylindrical portion of the first indicator wheel and the shaft portion of the third indicator wheel is constituted to penetrate the cylindrical portion of the second indicator wheel.

In one example, the first indicator wheel is a second wheel & pinion, the second indicator wheel is a center wheel & pinion and the third indicator wheel is an hour wheel.

In another example, the first indicator wheel is the second wheel & pinion, the second indicator wheel is a center wheel & pinion and the third indicator wheel is a 24 hour wheel.

Further, the electronic timepiece of the invention further comprises a first indicating member attached to the cylindrical portion of the first indicator wheel, a second indicating member attached to the cylindrical portion of the second indicator wheel, and a third indicating member attached to the shaft portion of the third indicator wheel.

For example, the first indicating member is a second hand, the second indicating member is a minute hand and the third indicating member is an hour hand.

Alternatively, the first indicating member is the second hand, the second indicating member is the minute hand and the third indicating member is a 24 hour hand.

Alternatively, the first indicating member is the minute hand, the second indicating member is the hour hand the third indicating member is the 24 hour hand.

The electronic timepiece of the invention is preferably constituted so that the first indicator wheel is rotated by one rotation per minute, the second indicator wheel is rotated by one rotation per hour and the third indicator wheel is rotated by one rotation per 12 hours.

Further, the electronic timepiece of the invention may be constituted so that the first indicator wheel is rotated by one rotation per minute, the second indicator wheel is rotated by one rotation per hour and the third indicator wheel is rotated by one rotation per 24 hours.

Further, the electronic timepiece of the invention may be constituted so that the first indicator wheel is rotated by one rotation per hour, the second indicator wheel is rotated by one rotation per 12 hours and the third indicator wheel is rotated by one rotation per 24 hours.

Further, the electronic timepiece of the invention is preferably provided with a center pipe for the first indicator wheel for rotatably guiding at least a portion of an inner peripheral face of the cylindrical portion of the first indicator wheel.

Further, the electronic timepiece of the invention is preferably provided with a center pipe for the second indicator wheel for rotatably guiding at least a portion of an inner peripheral face of the cylindrical portion of the second indicator wheel.

Further, the electronic timepiece of the invention can also be constituted to include a center pipe for the second indicator wheel for rotatably guiding at least a portion of an inner peripheral face of the cylindrical portion of the second indicator wheel, wherein at least a portion of an inner peripheral face of the cylindrical portion of the first indicator wheel is rotatably guided by an outer peripheral face of the cylindrical portion of the second indicator wheel.

By the foregoing construction, there can be realized an analog electronic timepiece having a high degree of freedom of designing indicators and a novel and easy-to-see indicating portion. Further, operation of indicators attached to indicator wheels can be stabilized.

DETAILED DESCRIPTION OF THE PREFERRED EMBODIMENTS

An explanation will be given of embodiments of an analog electronic timepiece according to the invention 4R with reference to the drawings as follows.

(1) First Embodiment of an Analog Electronic Timepiece According to the Invention Now, an explanation will be given of First Embodiment of an analog electronic timepiece according to the invention.

Figure 1:
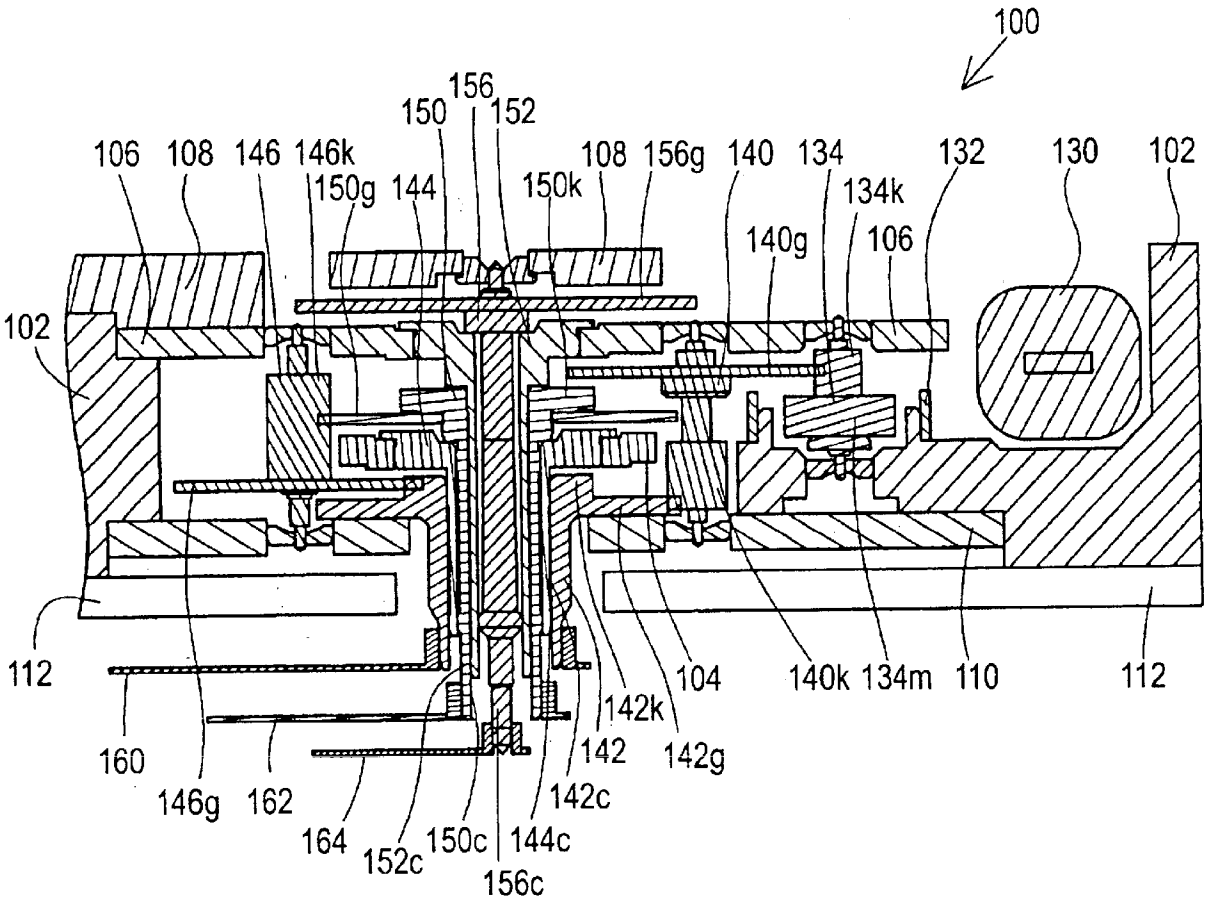
FIG. 1 is an outline partial sectional view showing a portion from a rotor of a movement to an indicator according to a first embodiment of an analog electronic timepiece of the invention.
Figure 3:
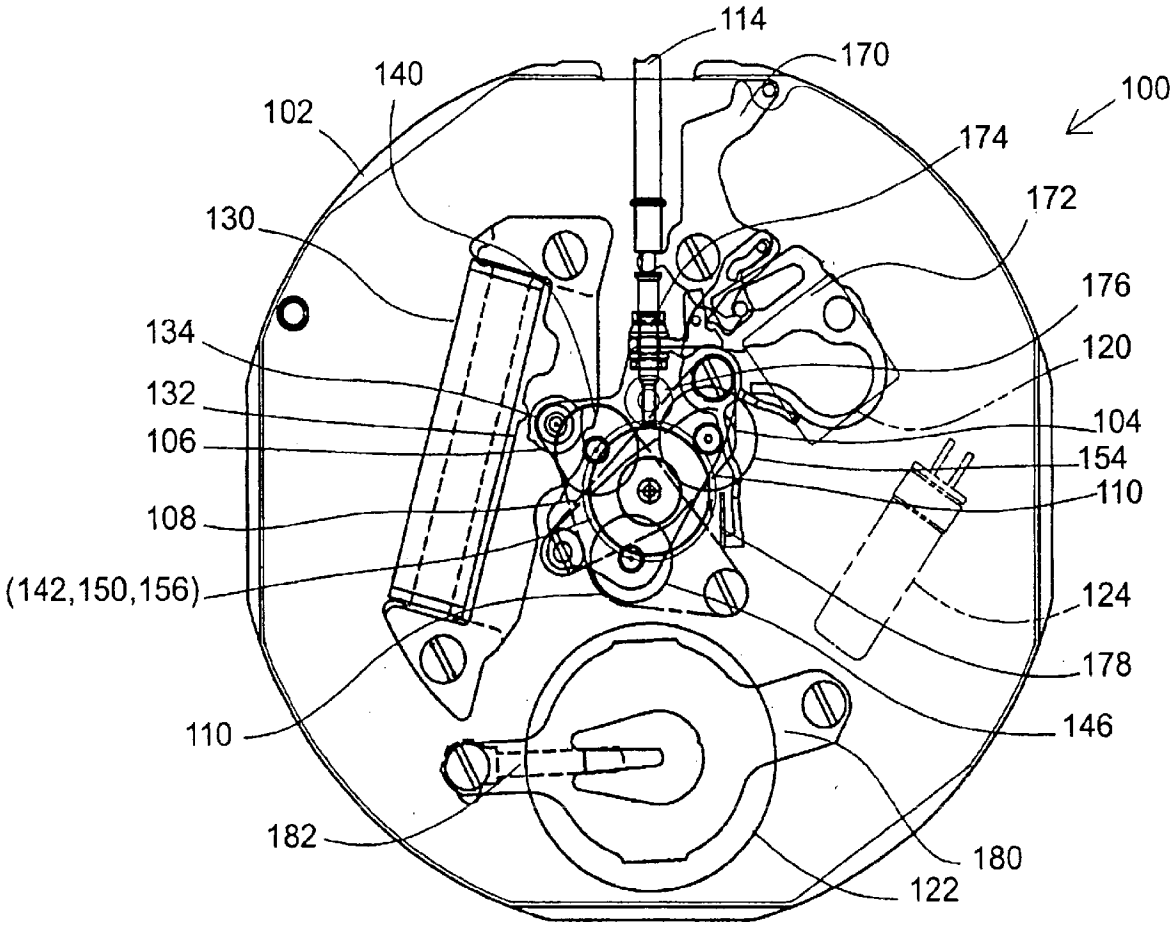
FIG. 3 is a plane view showing an outline shape viewing the movement from a top side according to the first embodiment of the analog electronic timepiece of the invention (in FIG. 3, portions of parts are omitted)

In reference to FIG. 1 and FIG. 3, a movement (machine body) 100 of an analog electronic timepiece of the invention is provided with a main plate 102, a first train wheel bridge 104, a second train wheel bridge 106, a third train wheel bridge 108 and a train wheel lower spacer 110. The first train wheel bridge 104, the second train wheel bridge 106 and the third train wheel bridge 108 are arranged on a top side of the main plate 102. On the top side of the main plate 102, the first train wheel bridge 104, the second train wheel bridge 106 and the third train wheel bridge 108 are arranged in this order from a side near the main plate 102 toward a position to be attached with a case back.

The train wheel lower spacer 110 is arranged on the back side of the main plate 102. A dial 112 is provided on the back side of the main plate 102 in the back side of the movement 100. A winding stem 114 is integrated to the main plate 102. The winding stem 114 is integrated, for example, in 3 o'clock direction of the timepiece.

An integrated circuit 120 is operated with a battery 122 as a power source. A crystal oscillator 124 constitutes an oscillation source. The crystal oscillator 124 is oscillated at, for example, 32, 768 Hertz and outputs a reference signal to the integrated circuit 120. The integrated circuit 120 includes a dividing circuit and the dividing circuit carries out predetermined dividing operation and outputs a signal of, for example, 1 Hertz. The integrated circuit 120 further includes a drive circuit and the drive circuit inputs an output signal outputted by the dividing circuit and outputs a predetermined drive signal for driving the step motor.

A coil block 130 magnetizes a plurality of poles of a stator 132 by inputting the drive signal outputted by the drive circuit for driving the step motor. A rotor 134 is provided with a rotor pinion 134*k* and a rotor magnet 134*m*. The rotor 134 is rotated by operation of magnetic force of the stator 132. An upper shaft portion (upper tenon) of the rotor 134 is rotatably supported by the second train wheel bridge 106. A lower shaft portion (lower tenon) of the rotor 134 is rotatably supported by the main plate 102. Therefore, the rotor 134 can be rotated between the second train wheel bridge 106 and the main plate 102. For example, the rotor 134 is rotated by 180 degrees per second based on the above-described 1 Hertz signal.

A fifth wheel & pinion 140 is provided with a fifth gear 140*g* and a fifth pinion 140*k*. An upper shaft portion (upper tenon) of the fifth wheel & pinion 140 is rotatably supported by the second train wheel bridge 106. A lower shaft portion (lower tenon) of the fifth wheel & pinion 140 is rotatably supported by the train wheel lower spacer 110. Therefore, the fifth wheel & pinion 140 can be rotated between the second train wheel bridge 106 and the train wheel lower spacer 110. The fifth gear 140*g* is arranged to be brought into mesh with the rotor pinion 134*k*. Therefore, the fifth wheel & pinion 140 can be decelerated to rotate based on rotation of the rotor 134.

A second wheel & pinion 142 is provided with a second wheel & pinion cylindrical portion 142*c*, a second gear 142*g* and a second pinion 142*k*. A center pipe 144 for the second wheel & pinion is provided at the first train wheel bridge 104. A guide cylinder portion 144*c* of the center pipe 144 for the second wheel & pinion, is extended orthogonally to the back face of the first train wheel bridge 104 to penetrate the dial 112 from a vicinity of a certain face of the back face of the first train wheel bridge 104. At least a portion of an inner peripheral face of the second wheel & pinion cylindrical portion 142*c*, is rotatably supported by an outer peripheral portion of the guide cylinder portion 140*c* of the center pipe 144 for the second wheel & pinion. Therefore, the second gear 142*g* and the second pinion 142*k* can be rotated between the first train wheel bridge 104 and the train wheel lower spacer 110.

The second gear 142*g* is arranged to be brought into mesh with the fifth pinion 142*k*. Therefore, the second wheel & pinion 142 can be decelerated to rotate based on rotation of the fifth wheel & pinion 140. Further, a speed reduction ratio from the rotor 134 to the second wheel & pinion 142 is constituted to 1/30. Therefore, the second wheel & pinion 142 is constituted to rotate one rotation per minute by rotating 6 degrees per second, A third wheel & pinion 146 is provided with a third gear 146*g* and a third pinion 146*k*. An upper shaft portion (upper tenon) of the third wheel and pinion 146 is rotatably supported by the second train wheel bridge 106. A lower shaft portion (lower tenon) of the third wheel & pinion 146 is rotatably supported by the train wheel lower spacer 110. Therefore, the third wheel & pinion 146 can be rotated between the second train wheel bridge 106 and the train wheel lower spacer 110. The third wheel 146*g* is arranged to be brought in mesh with the second pinion 142*k*. Therefore, the third wheel & pinion 146 can be decelerated to rotate based on rotation of the second wheel & pinion 142.

A center wheel & pinion 150 is provided with a center wheel & pinion cylindrical portion 150*c*, a second gear 150*g* and a center pinion 150*k*. The center gear 150*g* is attached to the center pinion 150*k* slippably to the center pinion 150*k* by predetermined slip torque. For example, a plurality of spring-like portions may be formed at the center gear 150*g* and the center gear 150*g* may be attached to the center pinion 150*k* so that the spring-like portions are fitted to a shaft portion for attaching the center pinion 150*k*.

A center pipe 152 for the center wheel & pinion is provided at the second train wheel bridge 106. A guide cylinder portion 152*c* of the center pipe 152 for the center wheel & train is extended orthogonally to the rear face of the second train wheel bridge 106 to penetrate the dial 112 from a vicinity of a certain face constituting the rear face of the second train wheel bridge 106. The guide cylinder portion 152*c* of the center pipe 152 for the center wheel & pinion is arranged to extend coaxially with the guide cylinder portion 144*c* of the center pipe 144 for the second wheel & pinion. There is provided a gap between an outer peripheral portion of the guide cylinder portion 152*c* of the center pipe 152 for the center wheel & pinion and an inner peripheral portion of the guide cylinder portion 144*c* of the center pipe 144 for the second wheel & pinion for passing the center wheel & pinion cylindrical portion 150*c*.

Center wheel & pinion guide band portions are provided at at least portions of the outer peripheral face of the guide cylinder portion 152*c* of the center pipe 152 for the center pinion & wheel. According to a structure shown by FIG. 1, the center wheel & pinion guide band portions are provided respectively at the base portion of the guide cylinder portion 152*c* and a portion thereof proximate to a front end thereof. The center wheel & pinion 150 is rotatably supported by outer peripheral faces of the center wheel & pinion guide band portions. According to the constitution, the outer peripheral face of the center wheel & pinion cylinder portion 152*c*, is arranged to constitute a gap relative to an inner peripheral face of the guide cylinder portion 140*c* of the center pipe 144 of the second wheel & pinion. Further, the center gear 150*g* and the center pinion 150*k* can be rotated between the first train wheel bridge 104 and the second train wheel bridge 106. Further, the center wheel & pinion 150 includes a portion capable of rotating between the center pipe 152 for the center wheel & pinion and the center pipe 144 for the second wheel & pinion in an axis line direction thereof.

The center gear 150*g* is arranged to be brought in mesh with the third pinion 146*k*. Therefore, the center wheel & pinion 150 can be decelerated to rotate based on rotation of the third wheel & pinion 146. Further, a speed reduction ratio from the second wheel & pinion 142 to the center wheel & pinion 150 is constituted to be 1/60. Therefore, the center wheel & pinion 150 is constituted to rotate by one rotation per hour.

As a modified example, the center wheel & pinion guide band portion may be provided at at least a portion of an outer peripheral face of the center wheel & pinion cylindrical portion 150*c*. According to the constitution, the center wheel & pinion 150 is rotatably supported by an inner peripheral face of the guide cylinder portion 144*c* of the center pipe 144 for the second wheel & pinion. Further, an inner peripheral face of the center wheel & pinion cylindrical portion 150*c* is arranged to constitute a gap relative to the outer peripheral face of the guide cylinder portion 152*c* of the center pipe 152 for the center wheel & pinion.

Figure 2:
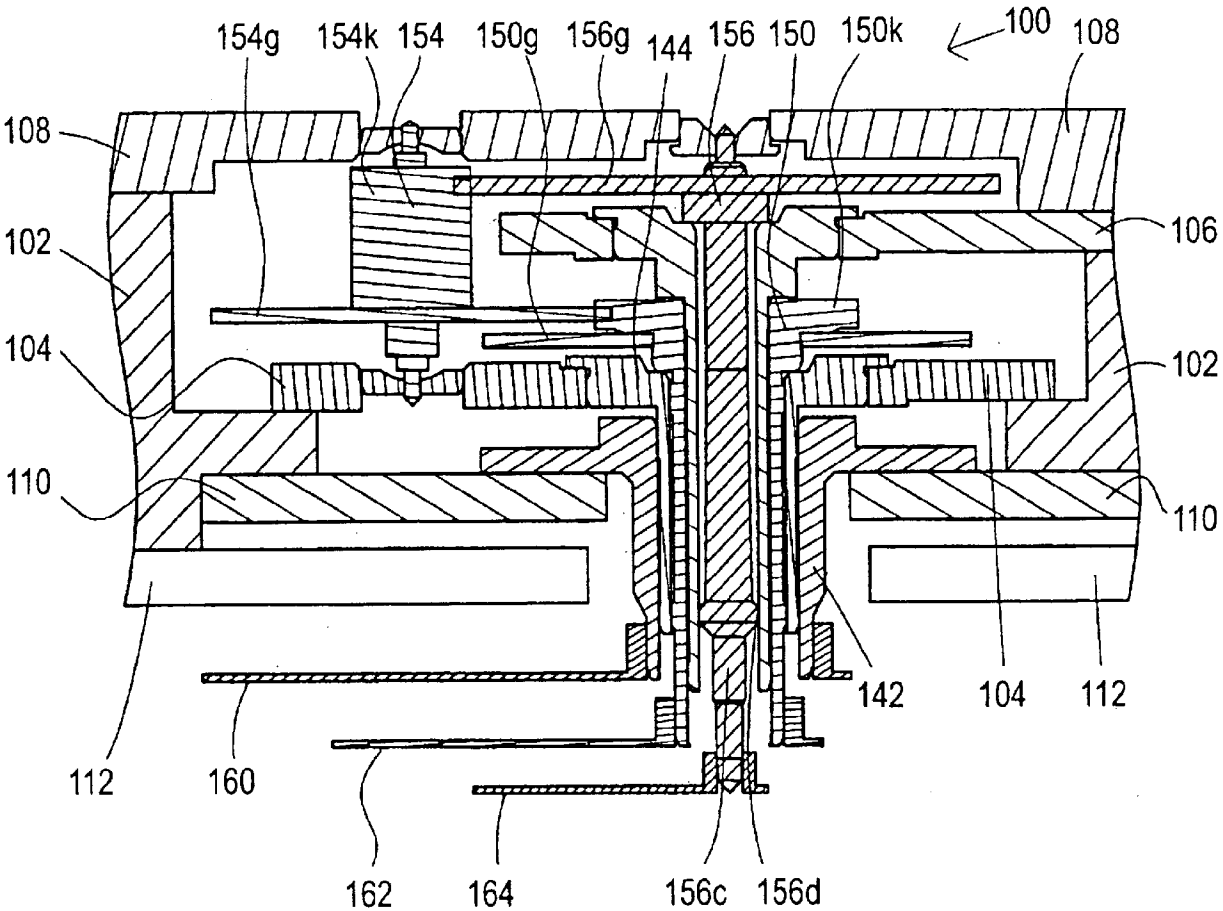
FIG. 2 is an outline partial sectional view showing a portion of a minute wheel of the movement and the indicator according to the first embodiment of the analog timepiece of the invention.

In reference to FIG. 2 and FIG. 3, a minute wheel 154 is provided with a minute wheel gear 154*g* and a minute pinion 154*k*. An upper shaft portion (upper tenon) of the minute wheel 154 is rotatably supported by the third train wheel bridge 108. A lower shaft portion (lower tenon) of the minute wheel 154 is rotatably supported by the first train wheel bridge 104. Therefore, the minute wheel 154 can be rotated between the third train wheel bridge 108 and the first train wheel bridge 104. The minute wheel gear 154*g* is arranged to be brought in mesh with the center pinion 154*k*. Therefore, the minute wheel 154 can be decelerated to rotate based on rotation of the center wheel & pinion 150.

In reference to FIG. 1 through FIG. 3, an hour wheel 156 is provided with an hour wheel shaft portion 156*c* and an hour wheel gear 156*g*. An abacus bead 156*d* is provided at a portion of the hour wheel shaft portion 156*c* proximate to a front end of the guide cylinder portion 152*c* of the center pipe 152 of the center wheel & pinion. An outer peripheral face of the abacus bead 156*d* is rotatably supported by the inner peripheral face of the guide shaft portion 152*c* of the center pipe 152 for the center wheel & pinion. Therefore, the hour wheel gear 156*g* can be rotated between the third train wheel bridge 108 and the second train wheel bridge 106. Further, the hour wheel 156 includes a portion capable of rotating between the third train wheel bridge 108 and the center pipe 152 of the center wheel & pinion in an axis line direction thereof.

The hour wheel gear 156*g* is arranged to be brought in mesh with the minute pinion 154*k*. Therefore, the hour wheel 156 can be decelerated to rotate based on rotation of the minute wheel 154. Further, a speed reduction ratio from the center wheel & pinion 150 to the hour wheel 156 is constituted to be 1/12. Therefore, the hour wheel 156 is constituted to rotate by one rotation per 12 hours.

By the foregoing construction, the second wheel & pinion 142, the center wheel & pinion 150 and the hour wheel 156 can coaxially be rotated.

In reference to FIG. 1 and FIG. 2, a second hand 160 is attached to the second wheel & pinion 142. A minute hand 162 is attached to the center wheel & pinion 150. An hour hand 164 is attached to the hour wheel 156. According to the constitution, "second" can be indicated by the second hand 160, "minute" can be indicated by the minute hand 162 and "hour" can be indicated by the hour hand 164.

In reference to FIG. 3, the movement 100 of the analog electronic timepiece of the invention, is further provided with a setting lever 170 and a yoke 172 constituting the switch apparatus. A clutch wheel 174 capable of being rotated by rotation of the setting stem 114 is integrated to the movement 100 to be fitted to the winding stem 114. A setting wheel 176 is integrated to the movement 100 to be brought in mesh with the minute wheel gear 154*g*. A train wheel stop lever 178 for restricting rotation of the second wheel & pinion 142, is integrated to the movement 100.

There is constructed a constitution in which when the winding stem 114 is pulled out, the setting lever 170 and the yoke 172 are operated and the clutch wheel 174 and the setting wheel 176 are brought in mesh with each other. There is constructed a constitution in which when the winding stem 114 is pulled out, the train wheel stop lever 178 is brought into contact with the second wheel & pinion 142 to thereby stop rotation of the second wheel & pinion 142.

Further, a battery connection (+) 180 and a battery connection (−) 182 are integrated to the movement 100. The battery connection (+) 180 is provided to conduct an anode of the battery 122 to the integrated circuit 120. The battery connection (−) 182 is provided to conduct a cathode of the battery 122 to the integrated circuit 120.

Next, an explanation will be given of the operation of the first embodiment of the analog electronic timepiece according to the invention.

In reference to FIG. 1 through FIG. 3, by rotation of the rotor 134, the second wheel & pinion 142 is decelerated to rotate via rotation of the fifth wheel & pinion 140, by rotation of the second wheel & pinion 142, the center wheel & pinion 150 is decelerated to rotate via rotation of the third wheel & pinion 146 and by rotation of the center wheel & pinion 150, the hour wheel 156 is decelerated to rotate via rotation of the minute wheel 154.

Figure 4:
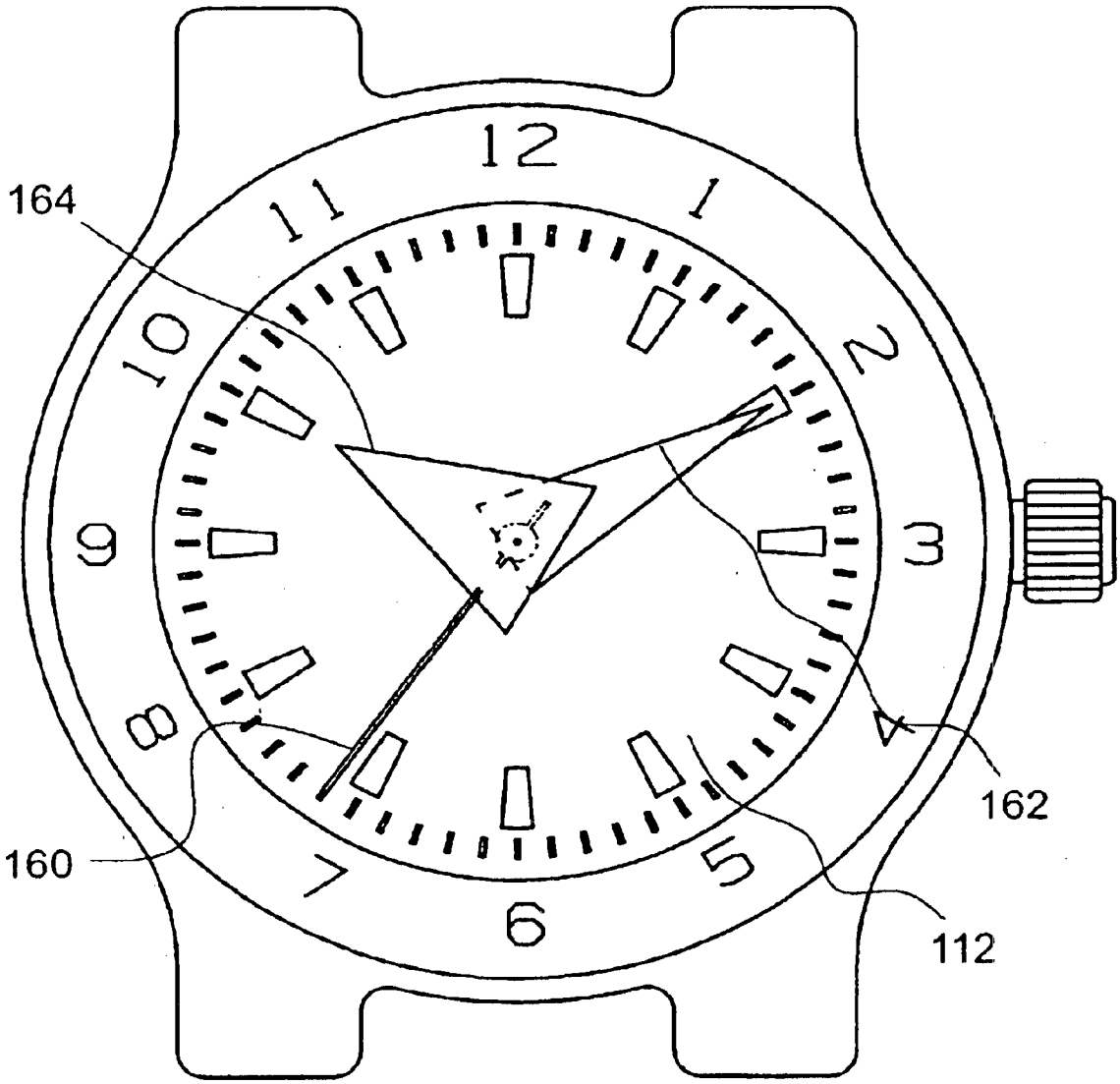
FIG. 4 is an outline plane view showing a complete outlook according to the first embodiment of the analog electronic timepiece of the invention.

Therefore, in reference to FIG. 4, "second" of current time can be indicated by the second hand 160, "minute" of current time can be indicated by the minute hand 162 and "hour", of current time can be indicated by the hour hand 164.

According to the first embodiment of the analog electronic timepiece of the invention, the second wheel & pinion 142 is rotatably supported by the outer peripheral face of the guide cylinder portion 144*c* of the center pipe 144 for the center wheel & pinion and therefore, the second hand 160 can be operated firmly and stably without being fluctuated or instigated.

Further, the center wheel & pinion 150 is rotatably supported by the outer peripheral face of the guide cylinder portion 152*c* of the center pipe 152 for the center wheel & pinion and therefore, the minute hand 162 can be operated firmly and stably without being fluctuated or instigated.

Further, the outer peripheral face of the abacus bead 156*d* of the hour wheel 156 is rotatably supported by the inner peripheral face of the guide cylinder portion 152*c* of the center pipe 152 for the center wheel & pinion and therefore, the hour hand 164 can be operated firmly and stably without being fluctuated or instigated.

(2) Second Embodiment of an Analog Electronic Timepiece According to the Invention Next, an explanation will be given of the Second Embodiment of an analog electronic timepiece according to the invention.

In the following explanation, a description will mainly be given of a point of the second embodiment of the analog electronic timepiece according to the invention different from the first embodiment of the analog electronic timepiece according to the invention. Therefore, the explanation of the first embodiment of the analog electronic timepiece according to the invention, mentioned above, is applied to a portion which is not described below.

Figure 5:
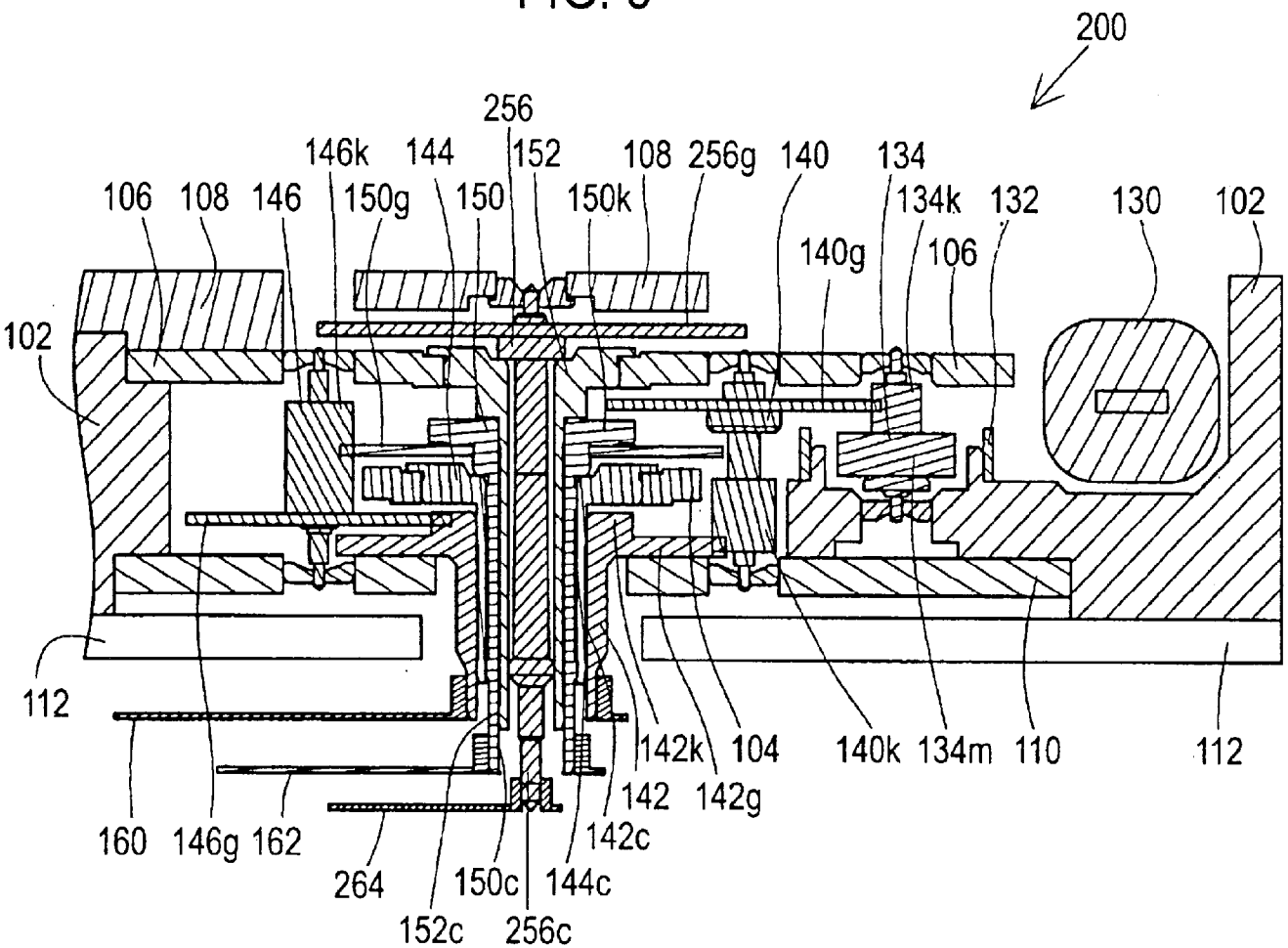
FIG. 5 is an outline partial sectional view showing a portion from a rotor of a movement to an indicator according to a second embodiment of an analog electronic timepiece of the invention.
Figure 6:
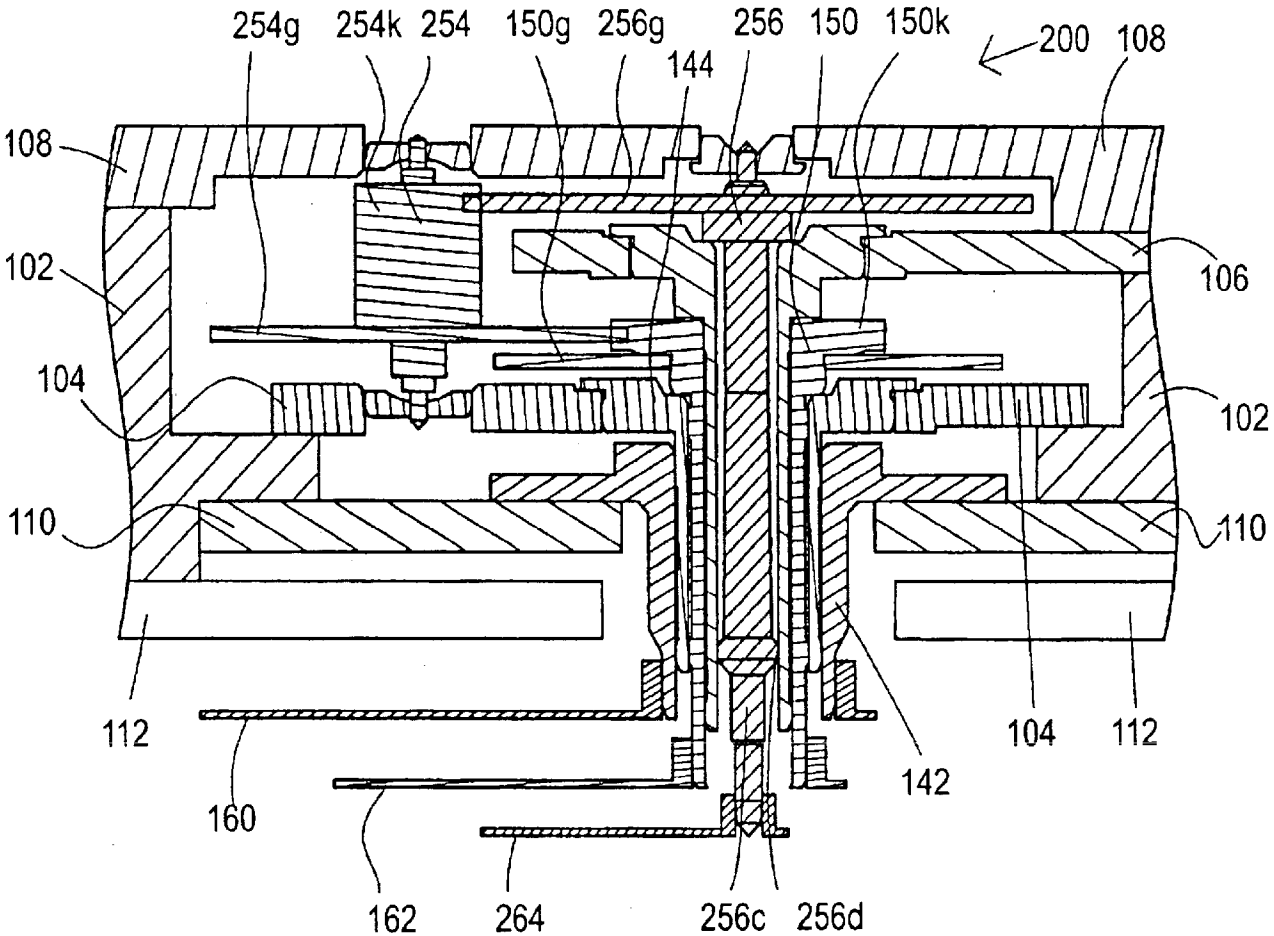
FIG. 6 is an outline partial sectional view showing a portion of a minute wheel of the movement and the indicator according to the second embodiment of the analog electronic timepiece of the invention.
Figure 7:
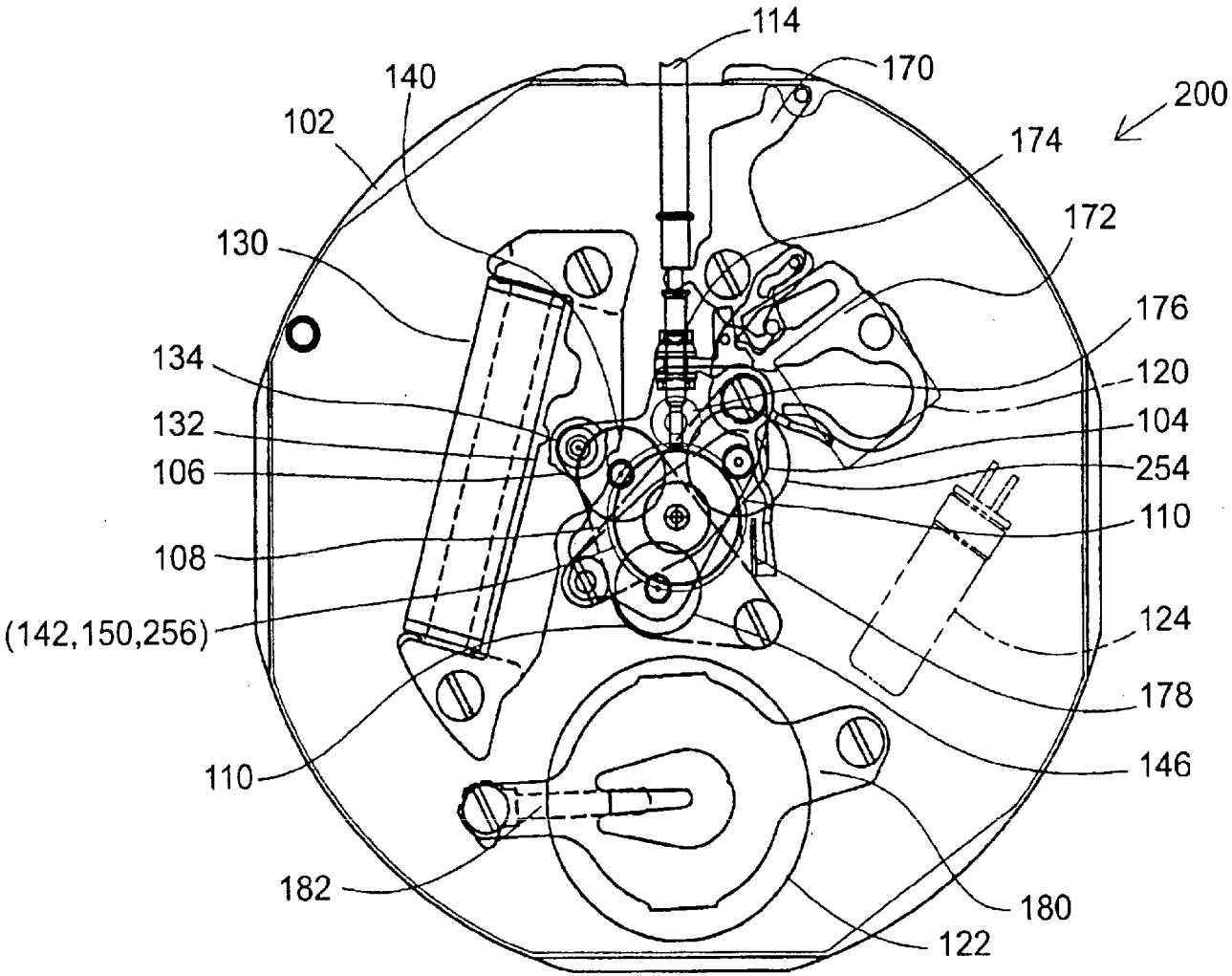
FIG. 7 is a plane view showing an outline shape viewing the movement from a top side according to the second ebodiment of the analog electronic timepiece of the invention (in FIG. 7, portions of parts are omitted)

In reference to FIG. 5 through FIG. 7, a movement (machine body) 200 of the analog electronic timepiece according to the invention is provided with the main plate 102, the first train wheel bridge 104, the second train wheel bridge 106, the third train wheel bridge 108 and the train wheel lower spacer 110. The train wheel lower spacer 110 is arranged on the back side of the main plate 102. The dial 112 is provided on the back side of the main plate 102 at the back side of the movement 200. The winding stem 114 is integrated to the main plate 102.

The movement 200 of the analog electronic timepiece according to the invention is provided with the integrated circuit 120, the battery 122, the crystal oscillator 124, the coil block 130, the stator 132, the rotor 134, the fifth wheel & train 140, the second wheel & train 142, the third wheel & train 146 and the center wheel & train 150. The center pipe 144 for the second wheel & pinion is provided at the first train wheel bridge 104. The center pipe 152 for the center wheel & pinion is provided at the second train wheel bridge 106.

In reference to FIG. 6 and FIG. 7, an hour transmission wheel & pinion 254 is provided with an hour transmission gear 254*g* and an hour transmission pinion 254*k*. An upper shaft portion (upper tenon) of the hour transmission wheel & pinion 254 is rotatably supported by the third train wheel bridge 108. A lower shaft portion (lower tenon) of the hour transmission wheel & pinion 154 is rotatably supported by the first train wheel bridge 104. Therefore, the hour transmission wheel & pinion 254 can be rotated between the third train wheel bridge 108 and the first train wheel bridge 104. The hour transmission gear 154*g* is arranged to be brought in mesh with the center pinion 150*k*. Therefore, the hour transmission wheel & pinion 154 can be decelerated to rotate based on rotation of the center wheel & pinion 150.

In reference to FIG. 5 through FIG. 7, a 24 hour wheel 256 is provided with a 24 hour wheel shaft portion 256*c* and a 24 hour gear 256*g*. An abacus bead 256*d* is provided at a portion of the 24 hour wheel shaft portion 256*c* proximate to the front end of the guide cylinder portion 152*c* of the center pipe 152 for the center wheel & pinion. An outer peripheral face of the abacus bead 256*d* is rotatably supported by the inner peripheral face of the guide cylinder portion 152*c* of the center pipe 152 for the center wheel & pinion. Therefore, the 24 hour gear 256*g* can be rotated between the third train wheel bridge 108 and the second train wheel bridge 106. Further, the 24 hour wheel 256 includes a portion capable of rotating between the third train wheel bridge 108 and the center pipe 152 for the center wheel & pinion in an axis line direction thereof.

The 24 hour gear 256*g* is arranged to be brought in mesh with the hour transmission pinion 254*k*. Therefore, the 24 hour wheel 256 can be decelerated to rotate based on rotation of the hour transmission wheel 254. Further, a speed reduction ratio from the center wheel & pinion 150 to the 24 hour wheel 256, is constituted to be 1/24. Therefore, the 24 hour wheel 256 is constituted to rotate by one rotation per 24 hours (1 day).

By the foregoing construction, the second wheel & pinion 142, the center wheel & pinion 150 and the 24 hour wheel 256 can coaxially be rotated.

In reference to FIG. 5 and FIG. 6, the second hand 160 is attached to the second wheel & pinion 142. The minute hand 162 is attached to the center wheel & pinion 150. A 24 hour hand 264 is attached to the 24 hour wheel 256. According to the constitution, "second" can be indicated by the second hand 160, "minute" can be indicated by the minute hand 162 and "hour" can be indicated by the 24 hour hand 264 in an indicating method constituting 24 hours by one turn of the 24 hour hand 264.

In reference to FIG. 7, the movement 200 of the analog electronic timepiece according to the invention is further provided with the setting lever 170, the yoke 172, the clutch wheel 174, the setting wheel 176 and the train wheel stop lever 178 constituting the switch apparatus, the battery connection (+) 180 and the battery connection (−) 182.

Next, an explanation will be given of operation of the second embodiment of the analog electronic timepiece according to the invention. In reference to FIG. 5 through FIG. 7, by rotation of the rotor 134, the second wheel & pinion 142 is decelerated to rotate via rotation of the fifth wheel & pinion 140, by rotation of the second wheel & pinion 142, the center wheel & pinion 150 is decelerated to rotate via rotation of the third wheel & pinion 146 and by rotation of the center wheel & pinion 150, the 24 hour wheel 256 is decelerated to rotate via rotation of the hour transmission wheel & pinion 254.

Figure 8:
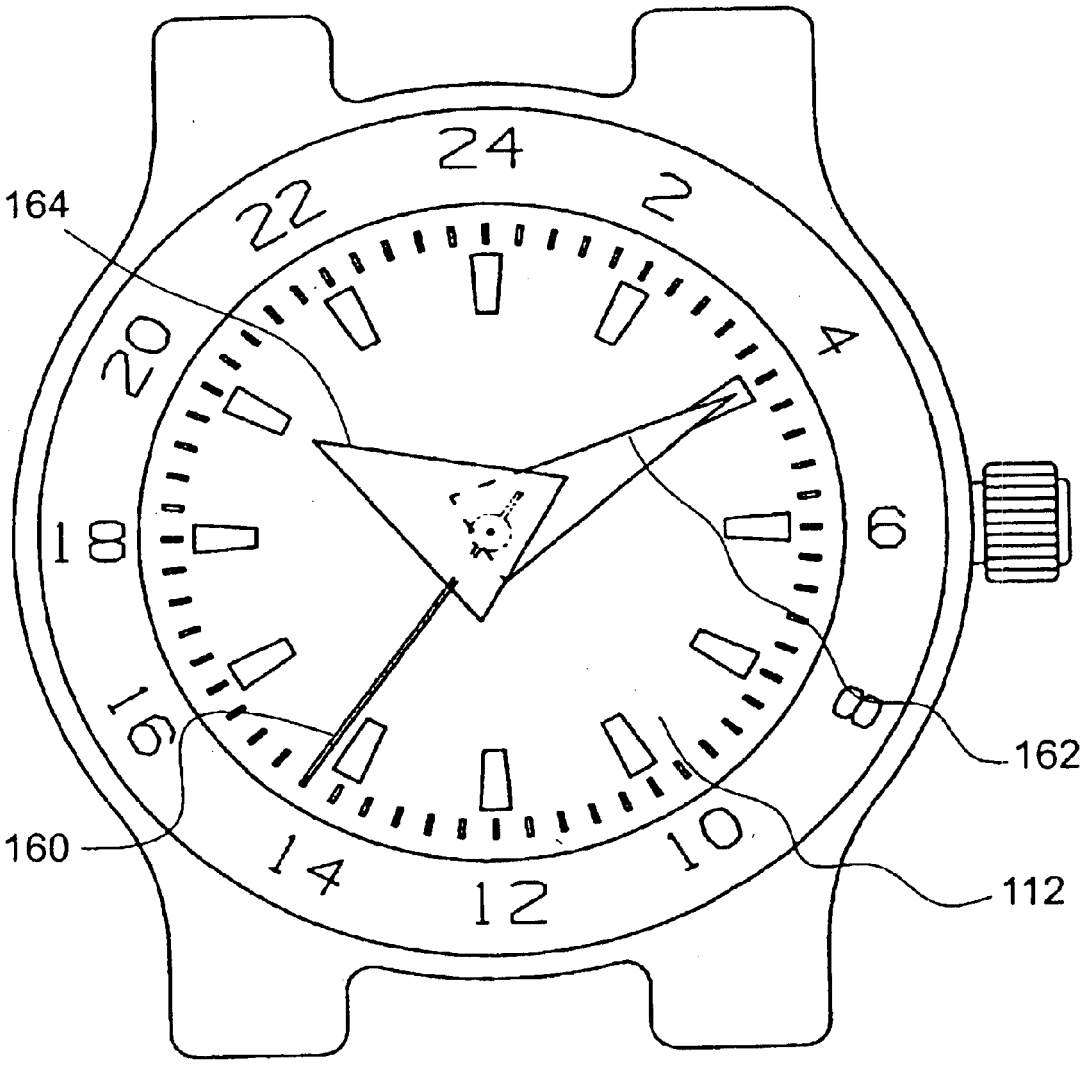
FIG. 8 is an outline plane view showing a complete outlook according to the second embodiment of the analog electronic timepiece of the invention.

Therefore, in reference to FIG. 8, "second" of current time can be indicated by the second hand 160, "minute" of current time can be indicated by the minute hand 162 and "hour" of current time can be indicated by the 24 hour hand 264 in the indicating method of constituting 24 hours by one turn of the 24 hour hand 264. According to the constitution, an outer peripheral portion of a case is provided with characters of "2", "4", "22", "24" to indicate hour in the indicating method of constituting 24 hours by one turn of the 24 hour hand 264.

According to the second embodiment of the analog electronic timepiece of the invention, the second wheel & train 142 is rotatably supported by the outer peripheral face of the guide cylinder portion 144*c* of the center pipe 144 for the second wheel & pinion and therefore, the second hand 160 can be operated firmly and stably without being fluctuated or instigated.

Further, the center wheel & pinion 150 is rotatably supported by the outer peripheral face of the guide cylinder portion 152*c* of the center pipe 152 for the center wheel & pinion and therefore, the minute hand 162 can be operated firmly and stably without being fluctuated or instigated.

Further, the outer peripheral face of the abacus bead 256*d* of the 24 hour wheel 256 is rotatably supported by the inner peripheral face of the guide cylinder portion 152*c* of the center pipe 152 for the center wheel & pinion and therefore, the 24 hour hand 264 can be operated firmly and stably without ill being fluctuated or instigated.

(3) Third Embodiment of an Analog Electronic Timepiece According to the Invention Next, an explanation will be given of Third Embodiment of an analog electronic timepiece according to the invention.

In the following explanation, a description will mainly be given of a point of the third embodiment of the analog electronic timepiece according to the invention different from the first embodiment of the analog electronic timepiece according to the invention. Therefore, the explanation of the first embodiment of the analog electronic timepiece according to the invention, described above, is applied to a portion which is not described below.

Figure 9:
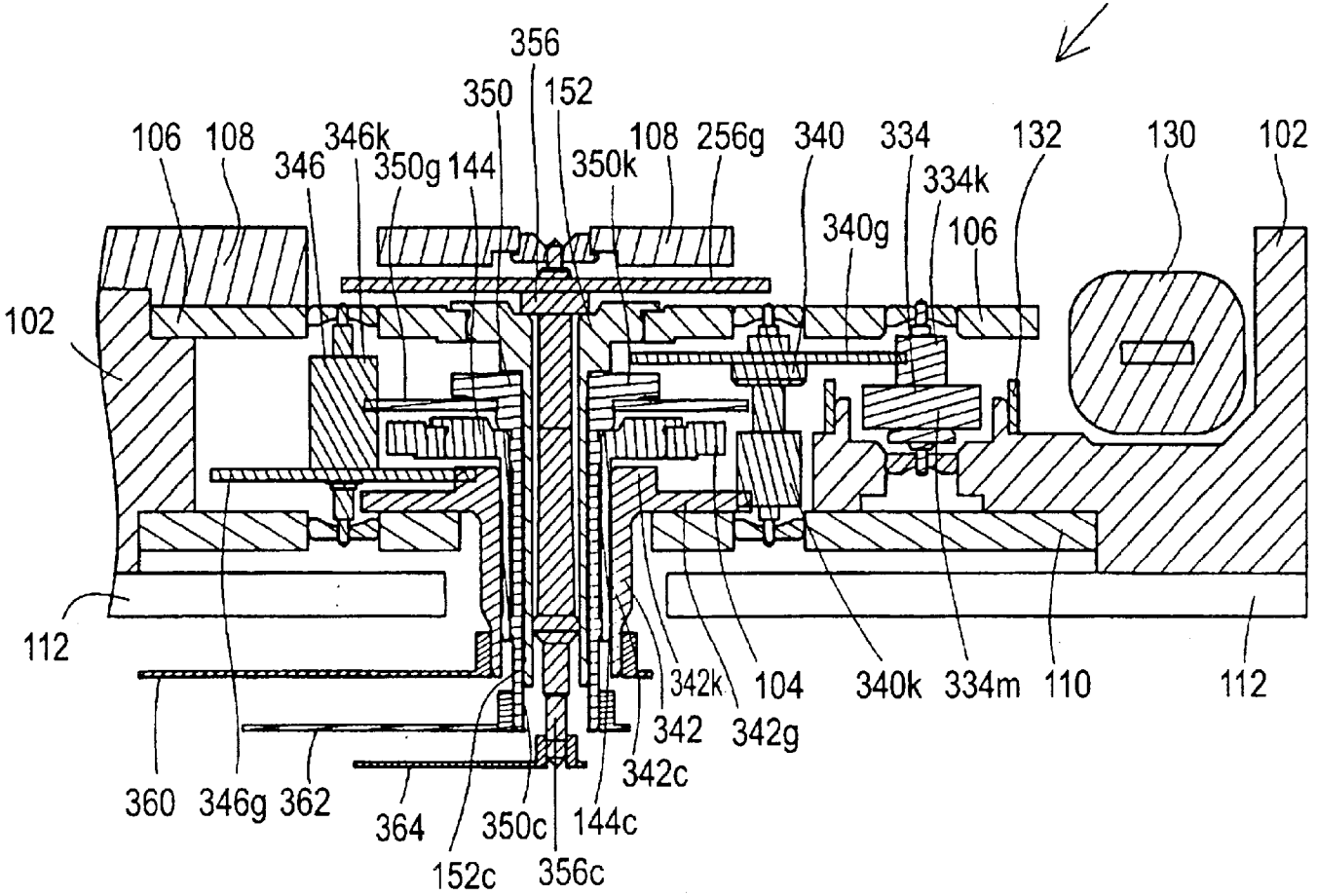
FIG. 9 is an outline partial sectional view showing a portion from a rotor of a movement to an indicator according to a third embodiment of an analog electronic timepiece of the invention.
Figure 10:
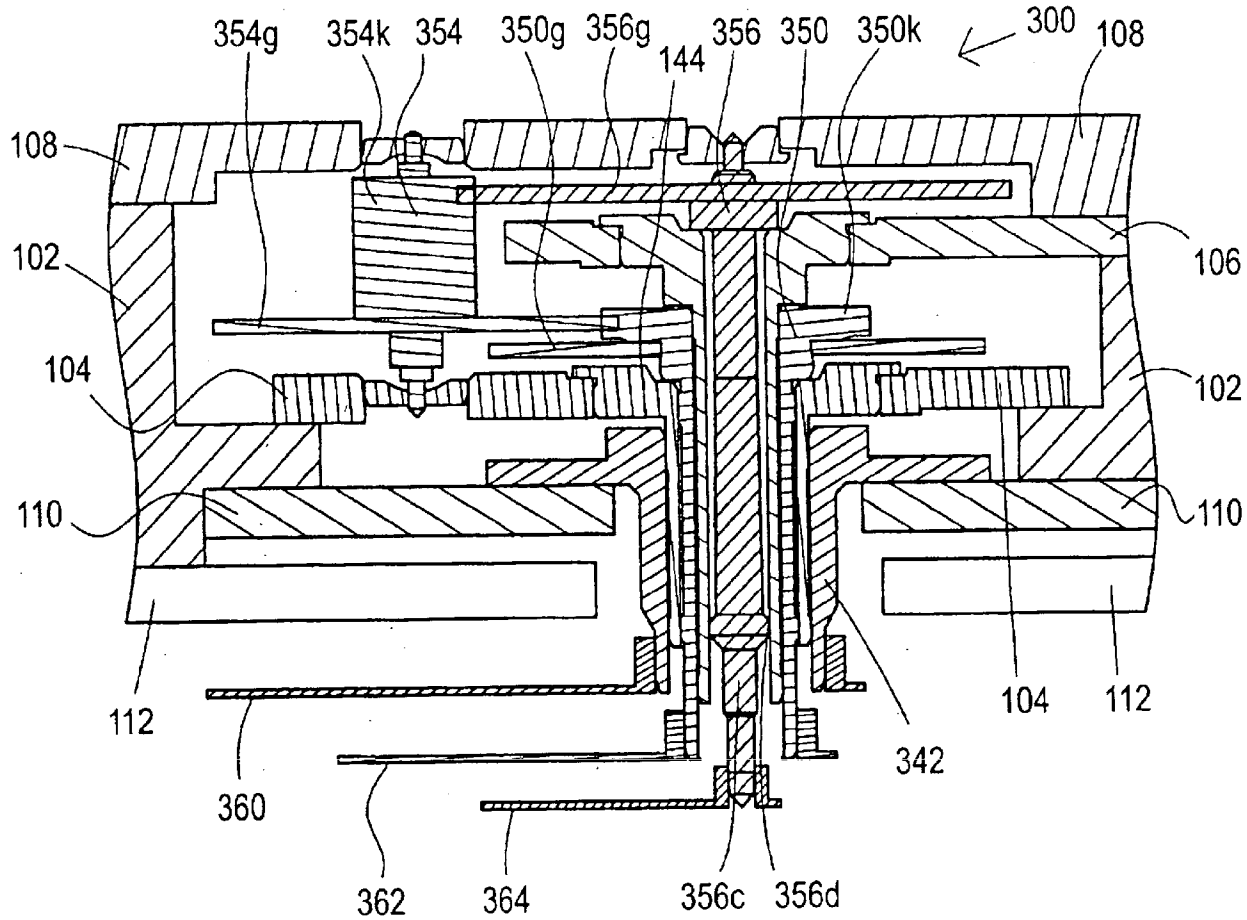
FIG. 10 is an outline partial sectional view showing a portion of a minute wheel of the movement and the indicator according to the third embodiment of the analog electronic timepiece of the invention.
Figure 11:
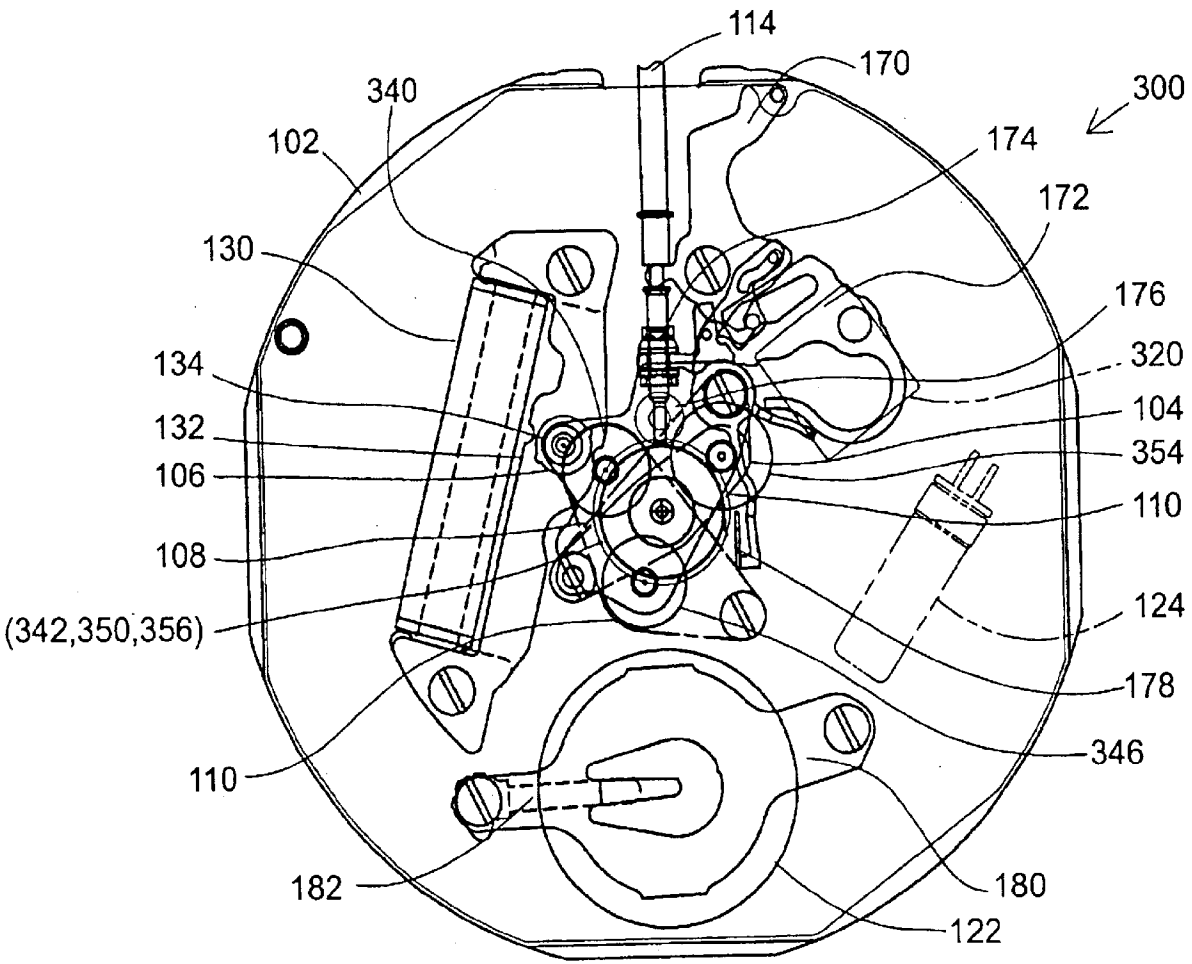
FIG. 11 is a plane view showing an outline shape viewing the movement from a top side according to the third embodiment of the analog electronic timepiece of the invention.

In reference to FIG. 9 through FIG. 11, a movement (machine body) 300 of the analog electronic timepiece of the invention is provided with the main plate 102, the first train wheel bridge 104, the second train wheel bridge 106, the third train wheel bridge 108 and the train wheel lower spacer 110. The first train wheel bridge 104, the second train wheel bridge 106 and the third train wheel bridge 108 are arranged on the top side of the main plate 102. The train wheel lower spacer 110 is arranged on the back side of the main plate 102. The dial 112 is provided on the back side of the main plate 102 in the back side of the movement 300. The winding stem 114 is integrated to the main plate 102.

An integrated circuit 320 is operated with the battery 122 as a power source. The crystal oscillator 124 constitutes the oscillation source. The integrated circuit 320 includes a dividing circuit and the dividing circuit carries out predetermined dividing operation and outputs an output signal, for example, at every 20 seconds. The integrated circuit 320 further includes a drive circuit and the drive circuit inputs an output signal outputted by the dividing circuit and outputs a predetermined drive signal for driving a step motor.

Further, the movement 300 is provided with the coil block 130, the stator 132 and a rotor 334. The rotor 334 is provided with a rotor pinion 334*k* and a rotor magnet 334*m*. For example, the rotor 334 is rotated by 180 degrees per 20 seconds based on the output signal outputted at every 20 seconds as described above.

A fifth wheel & pinion 340 is provided with a fifth gear 340*g* and a fifth pinion 340*k*. The fifth gear 340*g* is arranged to be brought in mesh with the rotor pinion 334*k*. Therefore, the fifth wheel & pinion 340 can be decelerated to rotate based on rotation of the rotor 334.

A second wheel & pinion 342 is provided with a second wheel & pinion cylinder portion 342*c*, a second gear 342*g* and a second pinion 342*k*. The center pipe 144 for the second wheel & pinion is provided at the first train wheel bridge 104. At least a portion of an inner peripheral face of the second train & wheel cylindrical portion 342*c*, is rotatably supported by the outer peripheral face of the guide cylinder portion 144*c* of the center pipe 144 for the second wheel & pinion. Therefore, the second gear 340*g* and the second pinion 340*k* can be rotated between the first train wheel bridge 104 and the train wheel lower spacer 110.

The second gear 342*g* is arranged to be brought in mesh with the fifth pinion 340*k*. Therefore, the second wheel & pinion 342 can be decelerated to rotate based on rotation of the fifth wheel & pinion 340. Further, a speed reduction ratio from the rotor 334 to the second wheel & pinion 342 is constituted to be 1/90. Therefore, the second wheel & pinion 342 is constituted to rotate by one rotation per hour by rotating 2 degrees per 20 seconds.

A third wheel & pinion 346 is provided with a third gear 346*g* and a third pinion 346*k*. The third gear 346*g* is arranged to be brought in mesh with the second pinion 342*k*. Therefore, the third wheel & pinion 346 can be decelerated to rotate based on rotation of the second wheel & pinion 342.

A center wheel & pinion 350 is provided with a center wheel & pinion cylindrical portion 350*c*, a center gear 350*g* and a center pinion 350*k*. The center gear 350*g* is attached to the center pinion 350*k* slippably to the center pinion 350*k* by predetermined slip torque.

The center pipe 152 for the center wheel & pinion is provided at the second train wheel bridge 106. The center gear 350*g* and the center pinion 346*k* can be rotated between the first train wheel bridge 104 and the second train wheel bridge 106. Further, the center wheel & pinion 350 includes a portion capable of rotating between the center pipe 152 for the center wheel & pinion and the center pipe 144 for the second wheel & pinion.

The center gear 350*g* is arranged to be brought in mesh with the third pinion 346*k*. Therefore, the center wheel & pinion 350 can be decelerated to rotate based on rotation of the third wheel & pinion 346. Further, a speed reduction ratio from the second wheel & pinion 342 to the center wheel & pinion 350 is constituted to be 1/12. Therefore, the center wheel & pinion 350 is constituted to rotate by one rotation per 12 hours.

In reference to FIG. 10 and FIG. 11, an hour speed reduction wheel & pinion 354 is provided with an hour speed reduction gear 354*g* and an hour speed reduction pinion 354*k*. An upper shaft portion (upper tenon) of the hour speed reduction wheel & pinion 354 is rotatably supported by the third train wheel bridge 108. A lower shaft portion (lower tenon) of the hour speed reduction wheel & pinion 354 is rotatably supported by the first train wheel bridge 104. Therefore, the hour speed reduction wheel & pinion 354 can be rotated between the third train wheel bridge 108 and the first train wheel bridge 104. The hour speed reduction gear 354*g* is arranged to be brought in mesh with the center pinion 350*k*. Therefore, the hour reduction wheel & pinion 354 can be decelerated to rotate based on rotation of the center wheel & pinion 350.

In reference to FIG. 9 through FIG. 11, a 24 hour wheel 356 is provided with a 24 hour wheel shaft portion 356*c* and a 24 hour gear 356*g*. An abacus bead 256*d* is provided at a portion of the 24 hour wheel shaft portion 356*c* proximate to the front end of the guide cylinder portion 152*c* of the center pipe 152 for the center wheel & pinion. An outer peripheral face of the abacus bead 356*d* is rotatably supported by the inner peripheral face of the guide cylinder portion 152*c* of the center pipe 152 for the center wheel & pinion. Therefore, the 24 hour gear 356*g* can be rotated between the third train wheel bridge 108 and the second train wheel bridge 106. Further, the 24 hour wheel 356 includes a portion capable of rotating between the third train wheel bridge 108 and the center pipe 152 for the center wheel & pinion in an axial line direction thereof.

The 24 hour gear 356*g* is arranged to be brought in mesh with the hour speed reduction pinion 354*k*. Therefore, the 24 hour wheel & pinion 356 can be decelerated to rotate based on rotation of the hour speed reduction wheel & pinion 354. Further, a speed reduction ratio from the center wheel & pinion 150 to the 24 hour wheel & pinion 356 is constituted to be ½. Therefore, the 24 hour wheel & pinion 356 is constituted to rotate by one rotation per 24 hours.

By the foregoing construction, the second wheel & pinion 342, the center wheel & pinion 350 and the 24 hour wheel & pinion 356 can coaxially be rotated.

In reference to FIG. 9 and FIG. 10, a minute hand 360 is attached to the second wheel & pinion 342. An hour hand 362 is attached to the center wheel & pinion 350. A 24 hour hand 364 is attached to the 24 hour wheel & pinion 356. According to the constitution, "minute" is indicated by the minute hand 360, "hour" is indicated by the hour hand 362 in a display method constituting 12 hours by one turn of the hour hand 362 and "hour" can be displayed by the hour hand 364 in a display method constituting 24 hours by one turn of the hour hand 364.

In reference to FIG. 11, the movement 300 of the analog electronic timepiece of the invention is further provided with the setting lever 170, the yoke 172, the clutch wheel 174, the setting wheel 176 and the train wheel stop lever 178 constituting the switch apparatus, the battery connection (+) 180 and the battery connection (−) 182.

Next, an explanation will be given of operation of the third embodiment of the analog electronic timepiece according to the invention. In reference to FIG. 9 through FIG. 11, by rotation of the rotor 334, the second wheel & train 342 is decelerated to rotate via rotation of the fifth wheel & pinion 340, by rotation of the second wheel & pinion 342, the center wheel & pinion 350 is decelerated to rotate via rotation the third wheel & pinion 346 and by rotation of the center wheel & pinion 350, the 24 hour wheel 356 is decelerated to rotate via rotation of the hour speed reduction wheel & pinion 354.

Figure 12:
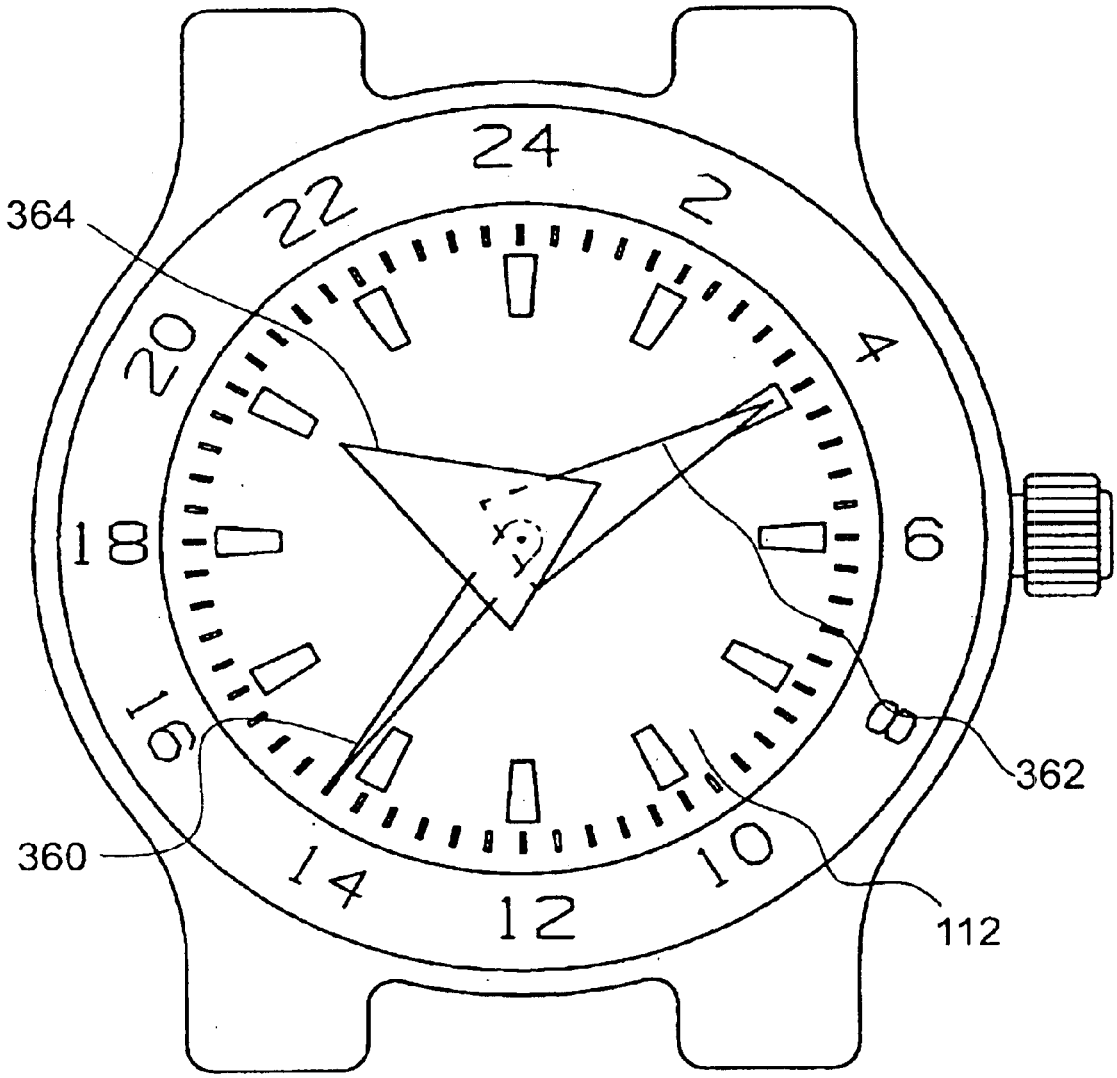
FIG. 12 is an outline plane view showing a complete outlook according to the third embodiment of the analog timepiece of the invention.

Therefore, in reference to FIG. 12, "minute" of current time is indicated by the minute hand 360, hour is indicated by the hour hand 362 in the display method constituting 12 hours by one turn of the hour hand 362 and "hour" is displayed by the hour hand 364 in the display method constituting 24 hours by one turn of the hour hand 364.

According to the third embodiment of the analog electronic timepiece of the invention, the second wheel & pinion 342 is rotatably supported by the outer peripheral face of the guide cylinder portion 144*c* of the center pipe 144 for the second wheel & pinion and therefore, the minute hand 360 can be operated firmly and stably without being fluctuated or instigated.

Further, the center wheel & pinion 350 is rotatably supported by the outer peripheral face of the guide cylinder portion 152*c* of the center pipe 152 for the center wheel & pinion and therefore, the hour hand 362 can be operated firmly and stably without being fluctuated or instigated.

Further, the outer peripheral face of the abacus bead 356*d* of the 24 hour wheel 356 is rotatably supported by the inner peripheral face of the guide cylinder portion 152*c* of the center pipe 152 for the center wheel & pinion and therefore, the 24 hour hand 364 can be operated firmly and stably without being fluctuated or instigated.

(4) Fourth embodiment of an Analog Electronic Timepiece According to the Invention An explanation will be given of the Fourth Embodiment of an analog electronic timepiece according to the invention.

In the following explanation, a description will mainly be given of a point of the fourth embodiment of the analog electronic timepiece according to the invention different from the first embodiment of the analog electronic timepiece according to the invention. Therefore, the explanation of the first embodiment of the analog electronic timepiece according to the invention, described above, is applied at a portion which is not described below.

Figure 13:
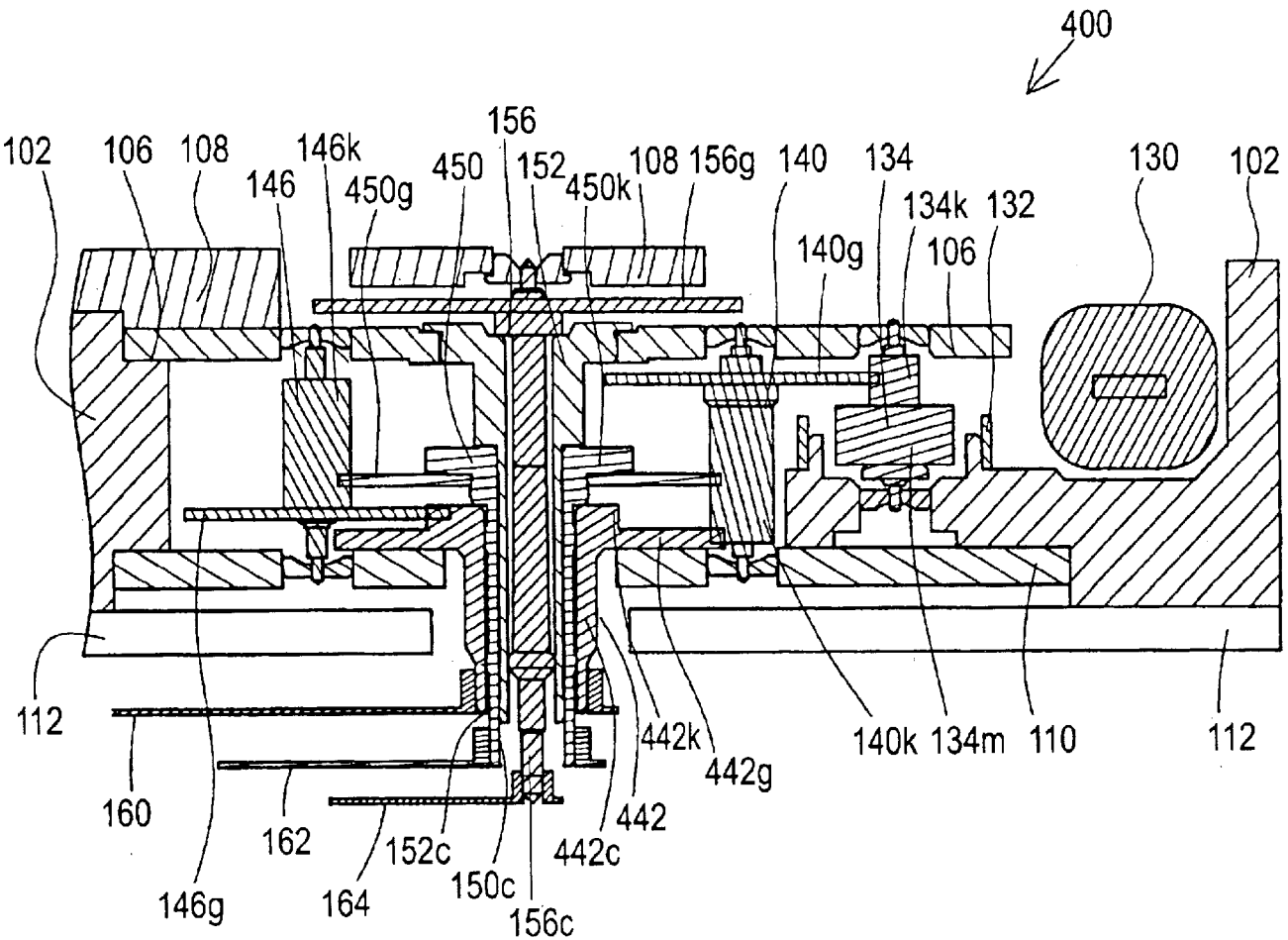
FIG. 13 is an outline partial sectional view showing a portion from a rotor of a movement to an indicator according to a fourth embodiment of an analog electronic timepiece of the invention.

In reference to FIG. 13, a movement (machine body) 400 of the analog electronic timepiece according to the invention is provided with the main plate 102, the second train wheel bridge 106, the third train wheel bridge 108 and the train wheel bridge lower spacer 110. The second train wheel bridge 106 and the third train wheel bridge 108 are arranged on the top side of the main plate 102. On the top side of the main plate 102, the second train wheel bridge 106 and the third train wheel bridge 108 are arranged in this order from a side proximate to the main plate 102 toward a position to be attached with a base back.

The train wheel lower spacer 110 is arranged on the back side of the main plate 102. The dial 112 is provided on the back side of the main plate 102 in the back side of the movement 400. The winding stem 114 is integrated to the main plate 102.

The movement 400 is provided with the integrated circuit 120, the battery 122, the crystal oscillator 124, the coil block 130, the stator 132, the rotor 134 and the fifth wheel & pinion 140.

A second wheel & pinion 442 is provided with a second wheel & pinion cylindrical portion 442*c*, a second gear 442*g* and a second pinion 442*k*. The movement 400 is not provided with the center pipe 144 for the second wheel & pinion. The second wheel & pinion 442 can be decelerated to rotate based on rotation of the fifth wheel & pinion 140.

The third wheel & pinion 146 is provided with the third gear 146*g* and the third pinion 146*k*. The third wheel & pinion 146 can be decelerated to rotate based on rotation of the second wheel & pinion 442.

A center wheel & pinion 450 is provided with a center wheel & pinion cylindrical portion 450*c*, a center gear 450*g* and a center pinion 450*k*. The center wheel 450*g* is attached with the center pinion 450*k* slippably to the center pinion 450*k* by predetermined slip torque.

The center pipe 152 for the center wheel & pinion is provided to the second train wheel bridge 106. The guide cylinder portion 152*c* of the center pipe 152 for the center wheel & pinion is extended orthogonally to the rear face of the second train wheel bridge 106 to penetrate the dial 112 from a vicinity of a certain face of the rear face of the second train wheel bridge 106.

The center wheel guide band portions are provided at at least portions of the outer peripheral face of the guide cylinder portion 152*c* of the center pipe 152 for the center wheel & pinion. According to a structure shown by FIG. 13, the center wheel guide band portions are provided respectively at a base portion of the guide cylinder portion 152*c* and a portion thereof proximate to a front end thereof. The center wheel & pinion 450 is rotatably supported by the outer peripheral faces of the center wheel guide band portions.

Second wheel guide band portions are provided at at least portions of the outer peripheral face of the center wheel & pinion cylindrical portion 450*c*. According to the structure shown by FIG. 13, the second wheel guide band portions are provided respectively at a base portion of the guide cylinder portion 452*c* and a portion thereof proximate to a front end thereof. An inner peripheral face of the second wheel & pinion cylindrical portion 442*c* of the second wheel & pinion 442 is rotatably supported by outer peripheral faces of the second wheel & pinion guide band portions of the center wheel & pinion 450.

The center gear 450*g* and the center pinion 450*k* can be rotated between the main plate 102 and the second gear 442*g*. Further, the center wheel & pinion 450 includes a portion capable of rotating between the center pipe 152 for the center wheel & pinion and the second wheel & pinion 442. Therefore, the second gear 442*g* and the second pinion 442*k* can be rotated between the main plate 102 and the center gear 450*g*.

The center gear 450*g* is arranged to be brought in mesh with third pinion 146*k*. Therefore, the center wheel & pinion 450 can be decelerated to rotate based on rotation of the third wheel & pinion 146.

According to the movement 400, structures of the minute wheel 154, the hour wheel 156 as well as other parts are similar to corresponding structures in the movement 100, described above.

According to the fourth embodiment of the analog electronic timepiece of the invention, by the single center pipe 152, the second wheel & pinion 442, the center wheel & pinion 450 and the hour wheel 156 can be supported coaxially and rotatably.

A structure of using only the single center pipe 152 according to the fourth embodiment of the analog electronic timepiece of the invention, is applicable to any of the first embodiment, the second embodiment and the third embodiment of the analog electronic timepieces according to the invention.

(5) Indicating Member used in an Embodiment of an Analog Electronic Timepiece According to the Invention Next, an explanation will be given of an example of an indicating member used in an embodiment of an analog electronic timepiece according to the invention.

Figure 14:
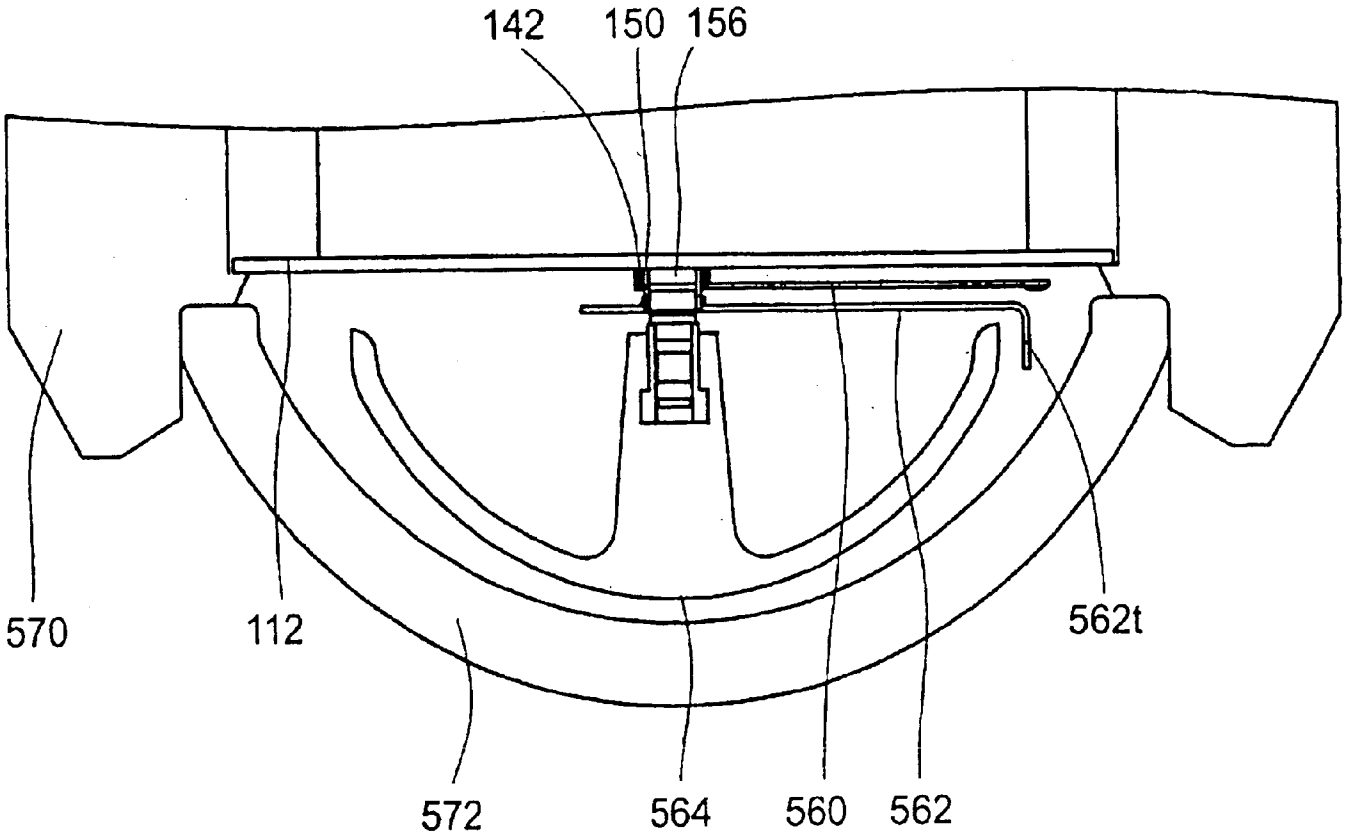
FIG. 14 is an outline partial sectional view showing an example of an indicating member used in an embodiment of an analog electronic timepiece according to the invention.

In reference to FIG. 14, a timepiece case includes a case body 570 and glass 572. The glass 572 is provided with a shape in correspondence with a portion of a sphere such as a semispherical shape, or, a shape of a quarter of a sphere, a shape of a third of a sphere or the like. A sectional shape of the glass 572 may be of a circular cone, may be of an ellipsoid of revolution, may be of a polyhedron, or may be of shapes in correspondence with portions of various solids of revolution formed by rotating other curves (hyperbola, parabola, exponential curve and the like). According to the example shown in FIG. 14, the sectional shape of the glass 572 is constituted by substantially in a shape of a quarter of a sphere.

A second indicating member 560 is attached to the second wheel & pinion 142 included in the movement 100. A minute indicating member 562 is attached to the center wheel & pinion 150 included in the movement 100. An hour indicating member 564 is attached to the hour wheel 156 included in the movement 100. According to the constitution, "second" can be indicated by the second indicating member 560, "minute" can be indicated by the minute indicating member 562 and "hour" can be indicated by the hour indicating member 564.

The second indicating member 560 may be constituted by a needle or may be constituted by a circular disk. The minute indicating member 562 may be constituted by a needle or may be constituted by a circular disk. According to an example shown by FIG. 14, the second indicating member 560 is constituted by a circular disk.

The hour indicating member 564 is provided with a shape in correspondence with a portion of a sphere such as a semispherical shape, or a shape of a quarter of a sphere, or a shape of a third of a sphere or the like. An outer peripheral shape of the hour indicating member 564 may be constituted by a shape substantially similar to an inner peripheral shape of the glass 572. A radius of curvature of an outer periphery of the hour indicating member 564 may be constituted to be a radius of curvature substantially the same as a radius of curvature of an inner periphery of the glass 572, or may be constituted to be a radius of curvature smaller than the radius of curvature of the inner periphery of the glass 572 or may be constituted to be a radius of curvature larger than the radius of curvature of the inner periphery of the glass 572. According to the example shown in FIG. 14, the outer periphery of the hour indicating member 564 is constituted by substantially a shape of a quarter of a sphere.

The outer peripheral shape of the hour indicating member 564 maybe of a circular cone, maybe of an ellipsoid of revolution, may be of a polyhedron or may be of shapes in correspondence with portions of various solids of revolution formed by rotating other curves (hyperbola, parabola, exponential curve and the like). Also in this case, the outer peripheral shape of the hour indicating member may be constituted by a shape substantially similar to the inner peripheral shape of the glass 572.

The hour indicating member 564 may be transparent, may be translucent or may be opaque.

The minute displaying member 562 may be provided with a front end portion 562*t* extending to a side of the glass 572. By this construction, time information can be indicated by mutual positional relationship between the time indicating member 564 and the front portion 562*t*.

A structure of the indicating member shown in FIG. 14 is applicable to any of the first embodiment through the fourth embodiment of the analog electronic timepieces of the invention.

By the foregoing construction, a three-dimensional time indicating member and a second indicating member in a shape of a circular disk can be combined.

According to the analog electronic timepiece of the invention, the hour hand can be attached not to the cylindrical portion but to the shaft portion and therefore, the operability in attaching the hour hand is improved, further, the operability in detaching the hour hand is also improved.

Further, the analog electronic time piece of the invention is provided with the novel and easy-to-see indicating portion having a high degree of freedom of designing the indicators.

What is claimed is:

1. An analog electronic timepiece comprising:

a rotor mounted for undergoing rotation;

a first indicator wheel for undergoing rotation about a rotational axis in accordance with rotation of the rotor, the first indicator wheel having a first cylindrical portion;

a second indicator wheel for undergoing rotation about the rotational axis in accordance with rotation of the first indicator wheel, the second indicator wheel having a second cylindrical portion extending through the first cylindrical portion of the first indicator wheel;

a third indicator wheel for undergoing rotation about the rotational axis in accordance with rotation of the second indicator wheel, the third indicator wheel having a shaft portion extending through the second cylindrical portion of the second indicator wheel;

a first indicating member connected to the first cylindrical portion of the first indicator wheel;

a second indicating member connected to the second cylindrical portion of the second indicator wheel; and a third indicating member connected to the shaft portion of the third indicator wheel.

2. An analog electronic timepiece according to claim 1; wherein the first indicator wheel undergoes one rotation per minute, the second indicator wheel undergoes one rotation per hour, and the third indicator wheel undergoes one rotation per 12 hours.

3. An analog electronic timepiece according to claim 1; wherein the first indicator wheel undergoes one rotation per minute, the second indicator wheel undergoes one rotation per hour, and the third indicator wheel undergoes one rotation per 24 hours.

4. An analog electronic timepiece according to claim 1; wherein the first indicator wheel undergoes one rotation per hour, the second indicator wheel undergoes one rotation per 12 hours, and the third indicator wheel undergoes one rotation per 24 hours.

5. An analog electronic timepiece according to claim 1; wherein the first indicator wheel has a center pipe for rotatably guiding at least a portion of an inner peripheral surface of the first cylindrical portion of the first indicator wheel.

6. An analog electronic timepiece according to claim 1; wherein the second indicator wheel has a center pipe for rotatably guiding at least a portion of an inner peripheral surface of the second cylindrical portion of the second indicator wheel.

7. An analog electronic timepiece according to claim 1; wherein the second indicator wheel has a center pipe for rotatably guiding at least a portion of an inner peripheral surface of the second cylindrical portion of the second indicator wheel; and wherein at least a portion of an inner peripheral surface of the first cylindrical portion of the first indicator wheel is rotatably guided by an outer peripheral surface of the second cylindrical portion of the second indicator wheel.

8. An analog electronic timepiece comprising:

a rotor mounted to undergo rotation;

a first indicator wheel for undergoing rotation in accordance with rotation of the rotor, the first indicator wheel having a first cylindrical portion;

a second indicator wheel coaxial with the first indicator wheel for undergoing rotation in accordance with rotation of the first indicator wheel, the second indicator wheel having a second cylindrical portion extending through the first cylindrical portion of the first indicator wheel; and a third indicator wheel coaxial with the first and second indicator wheels for undergoing rotation in accordance with rotation of the second indicator wheel, the third indicator wheel having a shaft portion extending through the second cylindrical portion of the second indicator wheel.

9. An analog electronic timepiece according to claim 8; further comprising a second hand connected to the first cylindrical portion of the first indicator wheel, a minute hand connected to the second cylindrical portion of the second indicator wheel, and an hour hand connected to the shaft portion of the third indicator wheel.

10. An analog electronic timepiece according to claim 8; wherein the third indicator wheel comprises an hour wheel.

11. An analog electronic timepiece according to claim 8; wherein the third indicator wheel comprises a 24 hour wheel.

* * * * *